US009585532B2

(12) United States Patent
Liffers et al.

(10) Patent No.: US 9,585,532 B2
(45) Date of Patent: Mar. 7, 2017

(54) BRUSH ROLLER OF A FLOOR CLEANING DEVICE

(71) Applicant: Stein & Co. GmbH, Velbert (DE)

(72) Inventors: Achim Liffers, Velbert (DE); Andreas Laaser, Hattingen (DE)

(73) Assignee: Stein & Co. GmbH, Velbert (DE)

( * ) Notice: Subject to any disclaimer, the term of this patent is extended or adjusted under 35 U.S.C. 154(b) by 0 days.

(21) Appl. No.: 14/004,955

(22) PCT Filed: Oct. 17, 2012

(86) PCT No.: PCT/DE2012/001026
§ 371 (c)(1),
(2) Date: Sep. 13, 2013

(87) PCT Pub. No.: WO2013/056694
PCT Pub. Date: Apr. 25, 2013

(65) Prior Publication Data

US 2014/0000054 A1 Jan. 2, 2014

(30) Foreign Application Priority Data

Oct. 18, 2011 (DE) ..... 10 2011 116 419

(51) Int. Cl.
*A47L 9/04* (2006.01)
*A46B 13/00* (2006.01)

(52) U.S. Cl.
CPC ..... *A47L 9/0477* (2013.01); *A46B 13/006* (2013.01); *A47L 9/0455* (2013.01)

(58) Field of Classification Search
CPC ..... A46B 5/0095; A46B 7/04; A46B 7/10; A46B 13/001; A46B 13/006; A47L 9/04; A47L 9/0477
(Continued)

(56) References Cited

U.S. PATENT DOCUMENTS 22,678 A 1/1859 Smith
2,734,211 A * 2/1956 Vance ..... 15/183
(Continued)

FOREIGN PATENT DOCUMENTS

DE 917 498 9/1954
DE 197 28 380 1/1999
(Continued)

OTHER PUBLICATIONS

International Search Report of the International Searching Authority for International Application PCT/DE2012/001026, mailed Feb. 14, 2013, 3 pages, European Patent Office, HV Rijswijk, Netherlands.
(Continued)

*Primary Examiner* — Larry E Waggle, Jr.
*Assistant Examiner* — Stephanie Berry
(74) *Attorney, Agent, or Firm* — W. F. Fasse

(57) ABSTRACT

A rotating brush roller of a floor care device is a cylindrical rotational element including a hollow body as a central piece and end pieces to be supported via bearings in a brush housing of the floor care device. A spiral, outwardly open, receiving shaft or groove is provided in the outer circumferential surface of the hollow body for receiving and retaining therein a continuous spiral brush strip. The central piece is a self-supporting hollow body of plastic, into opposite ends of which the end pieces engage with a form-fitting connection. The receiving shaft for receiving the brush strip continues at least partially in the end pieces.

18 Claims, 1 Drawing Sheet

(58) Field of Classification Search
USPC ..... 15/179, 182
See application file for complete search history.

(56) References Cited

U.S. PATENT DOCUMENTS

| | | | | |
|---|---|---|---|---|
| 3,225,374 | A | 12/1965 | Daley et al. | |
| 3,874,017 | A | 4/1975 | Parker | |
| 4,238,870 | A * | 12/1980 | Fahlen | A47L 9/0477 15/183 |
| 4,437,199 | A | 3/1984 | Wulf et al. | |
| 5,231,725 | A | 8/1993 | Hennessey et al. | |
| 5,249,328 | A | 10/1993 | Shin | |
| 5,272,785 | A | 12/1993 | Stegens | |
| 5,465,451 | A * | 11/1995 | Stegens | A47L 9/0455 15/179 |
| 7,805,795 | B2 | 10/2010 | Stein et al. | |
| D680,289 | S * | 4/2013 | Gray | A47L 9/04 D32/31 |
| 2003/0145424 | A1* | 8/2003 | Stephens et al. | 15/392 |
| 2005/0246857 | A1 | 11/2005 | Omoto et al. | |
| 2013/0042429 | A1 | 2/2013 | Misumi et al. | |
| 2014/0066278 | A1 | 3/2014 | Stein et al. | |

FOREIGN PATENT DOCUMENTS

| | | |
|---|---|---|
| DE | 102007006654 | 8/2008 |
| WO | WO 2006/061045 | 6/2006 |
| WO | WO 2011/125580 | 10/2011 |

OTHER PUBLICATIONS

PCT International Preliminary Report on Patentability including English Translation of PCT Written Opinion of the International Searching Authority for International Application PCT/DE2012/001026, issued Apr. 22, 2014, 7 pages, International Bureau of WIPO, Geneva, Switzerland.

* cited by examiner

BRUSH ROLLER OF A FLOOR CLEANING DEVICE

FIELD OF THE INVENTION

The invention relates to a brush roller of a floor care device, especially carpet cleaning device in the form of a brush vacuum cleaner or a brush attachment or accessory with at least one rotating brush roller as a cylindrical rotational element, wherein the brush roller is arranged by outwardly located end pieces via bearings in a brush housing, and the brush roller as a hollow body comprises a spirally extending receiving shaft with an outwardly located through-passage area for receiving and retaining a continuous brush strip as well as an opening on the end face side for provision and removal.

BACKGROUND INFORMATION

Brush rollers of this type are known in various different embodiments, whereby these are either fixedly bristled and only exchangeable as a whole, or are embodied of several parts and comprise a spiral-shaped receiving shaft for a brush strip. In an embodiment with a spiral-shaped receiving shaft, the brush rollers are typically divided at the center and for the brush strip have a stabilizing steel pipe side with inserted shaft ends for allocation with axially externally arranged bearings.

Because relatively large forces act on the brush roller, for machine or tool-related technical reasons there are difficulties in economically producing brush rollers of this type as a continuous brush roller with the required bending stiffness and form stability.

An arrangement according to the above general field of the invention with a brush roller is already known from the DE 917 498 B. In that regard, the roller is provided at each end with a bearing arrangement, by which it is carried in a mutually rotating manner via flanges on a continuous central axle or spindle. This construction is relatively complex and also not manageable by a layman for exchanging the brush strip.

SUMMARY OF THE INVENTION

It is an object of an embodiment of the invention to provide a brush roller body for a brush roller according to the above general field of the invention with a spirally arranged receiving shaft for a brush strip without additional stabilizing components, which makes possible a form-stable arrangement that is stiff or strong as to the connection and as to bending, and ensures a lightweight structural embodiment with a continuous brush strip receiver.

The solution to this object is achieved according to an embodiment of the invention in that a central segment and the two end pieces form the brush roller, and the central segment comprises at least 50% of the total length of the brush roller, wherein the central segment is formed as a self-supporting hollow body of plastic and comprises at least one receiving shaft that extends spirally along its outer circumferential surface, and the end pieces engage with a form-fitting connection into the hollow body of the central segment, and the end pieces comprise shaft ends for reception in corresponding bearings in the outer area, and the connected end pieces at least partially continue the receiving shaft for the brush strip.

Hereby it is made possible to utilize a self-supporting hollow body of plastic and also to guide the brush strip via the inserted end pieces.

It is provided in an advantageous manner that the central segment is formed as a self-supporting hollow body by concentric pipe bodies that are spaced apart by ribs, and the receiving shaft with its outwardly located through passage area is arranged between the pipe bodies.

A further improvement is achieved in that the end pieces comprise shaft ends for reception in corresponding bearings in the outer area of the brush housing.

Furthermore it is provided that the end pieces comprise deflector elements as thread deflectors in the area facing away from the central segment.

For a good functionality it is provided that the end pieces are insertable in the hollow body of the central segment via elements of elastic material, such as O-rings, in a radial force-transmitting and form-fitting manner.

For adjustedly setting a trouble-free rotation of the brush roller it is provided that the end pieces at their outwardly located end faces comprise receiving openings for balancing weights.

BRIEF DESCRIPTION OF THE DRAWINGS

An example embodiment of the invention is schematically illustrated in the drawing. It is shown by.

DETAILED DESCRIPTION OF EXAMPLE EMBODIMENTS OF THE INVENTION

Figure 1:
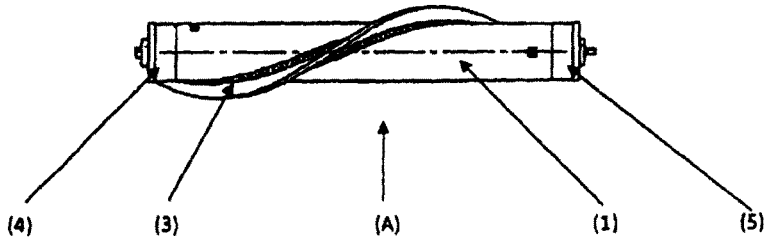
FIG. 1 a view of a brush roller consisting of a central segment and outwardly located end pieces as well as an inserted brush strip.
Figure 2:
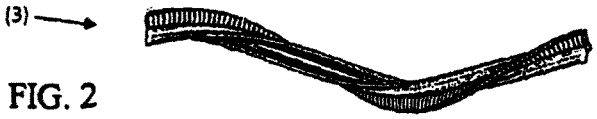
FIG. 2 a brush strip.
Figure 3:
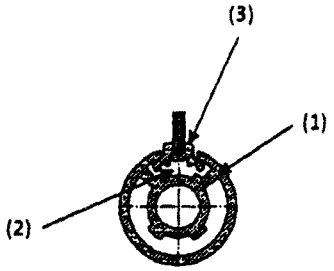
FIG. 3 a cross-section of a brush roller.

The illustrated brush roller A as a cylindrical rotational element consists of a central segment 1 as a self-supporting hollow body and end pieces 4, 5 inserted at the ends. A spiral-shaped recessed or let-in receiving shaft 2 for receiving and retaining a continuous brush strip 3 is arranged on the outer circumferential surface of the brush roller A.

The central segment 1 as a self-supporting hollow body is formed by concentric pipe bodies, that are held spaced apart by ribs, wherein the structure consists of plastic and is preferably produced as an injection molded part. In that regard, the receiving shaft 2 for the brush strip 3 with an outwardly located through-passage area is arranged between the pipe bodies of the central segment 1.

The end pieces 4, 5 are fixable or securable against axial and rotational movements in the receiving area 7 in the central segment 1 in a form-fitting manner, and continue the central segment 1 including the receiving shaft 2 for the brush strip 3. In this regard, the end pieces 4, 5 are elastically arranged in the receiving area 7 via parallel arranged, axially fixed O-rings 6.

Figure 4:
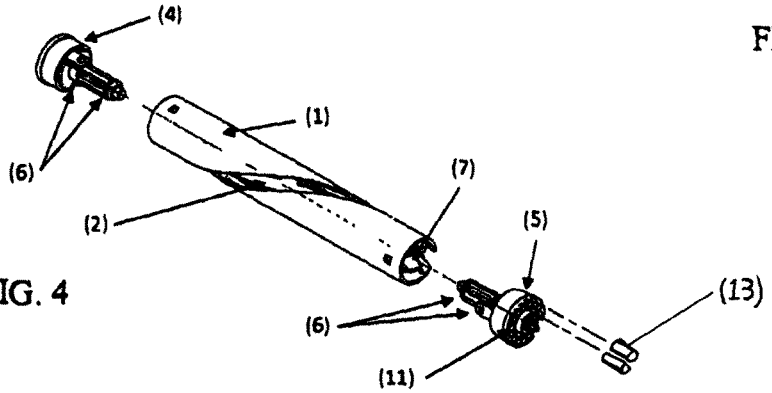
FIG. 4 a graphic diagrammatic illustration of a brush roller according to FIG. 1.
Figure 5:
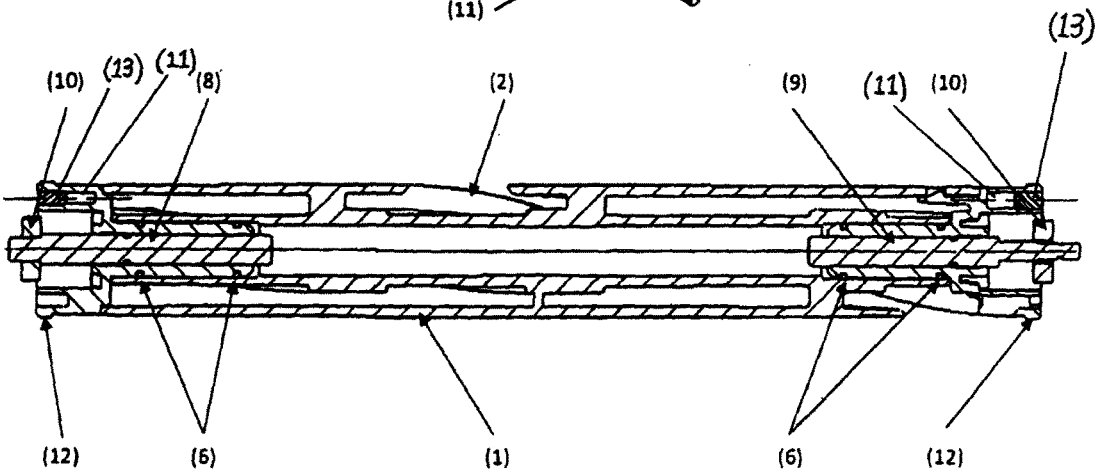
FIG. 5 a longitudinal section through a brush roller.

In that regard, the end pieces 4, 5 have shaft ends 8, 9 guided outwardly, which are allocated to bearings 10 arranged correspondingly at the end face side in a brush housing. Additionally, deflector elements 12 as thread deflectors are arranged on the end pieces 4, 5 in the area facing away. The outer end faces of the end pieces 4, 5 have receiving openings or holes 11 therein, and balancing weights 13 received in the holes 11 (as illustrated in an exploded or disassembled view for clarity in FIG. 4 and as assembled in FIG. 5).

The invention claimed is:

1. Brush roller of a floor care device, wherein:

the brush roller as a cylindrical rotational element comprises a central segment and outwardly located first and second end pieces, the brush roller is configured and adapted to be arranged by the end pieces via bearings in a brush housing of the floor care device, the brush roller as a hollow body comprises a receiving shaft extending spirally along the central segment with an outwardly located through passage area for receiving and retaining a continuous brush strip, and the receiving shaft extends along the first end piece to an opening that is located on an end face side of the first end piece and that communicates into the receiving shaft for insertion and removal of the brush strip, the central segment comprises at least 50% of the total length of the brush roller, the central segment is formed as a self-supporting hollow body of plastic and comprises the receiving shaft extending spirally along an outer circumferential surface of the central segment, the end pieces engage with a form-fitting connection into the hollow body of the central segment, the end pieces comprise shaft ends for being received in the bearings of the floor care device, the second end piece continues the receiving shaft for the brush strip extending axially beyond an axial end of the central segment, the receiving shaft extends spirally along an entire axial length of the central segment and the first and second end pieces, the second end piece has an opening of the receiving shaft on an end face side of the second end piece, and the brush strip can be slidingly inserted into and removed from the receiving shaft through both the opening on the end face side of the first end piece and the opening on the end face side of the second end piece.

2. Brush roller according to claim 1, characterized in that the central segment is formed as a self-supporting hollow body by concentric pipe bodies spaced radially apart by ribs, and the receiving shaft with its outwardly located through passage area is arranged between the pipe bodies.

3. Brush roller according to claim 1, characterized in that the end pieces comprise deflector elements in the area facing away from the central segment.

4. Brush roller according to claim 1, characterized in that the end pieces are insertable in a radial force-transmitting and form-fitting manner into the hollow body of the central segment via elements of elastic material.

5. Brush roller according to claim 1, characterized in that the end pieces at their outwardly located end face sides comprise receiving openings and balancing weights received therein.

6. A brush roller for a floor care device, comprising:

a cylindrical brush body that extends axially along an axis, is made of plastic, has a hollow interior space therein, and has a spiral groove extending spirally about said axis in an outer circumferential surface of said brush body;

two end pieces that are partially inserted into said hollow interior space at two opposite axial ends of said brush body, and each have a spiral extension groove which extends spirally about said axis in an outer circumferential surface of a respective one of said end pieces and which is aligned with and continues said spiral groove of said brush body axially beyond axial ends of said brush body;

two shaft pieces that extend along said axis, are inserted into and held by said two end pieces respectively, and each respectively include an axially protruding shaft end adapted to be received in a respective bearing of said floor care device; and a spiral brush strip that is removably inserted and retained in said spiral groove of said brush body and said spiral extension grooves of said end pieces;

wherein said brush body has an axial length amounting to at least 50% of a total axial length of said brush body plus said two end pieces inserted therein, and is sufficiently stiff to be self-supporting axially between said two end pieces; and wherein said spiral extension groove of a first one of said end pieces extends entirely along an axial length of said first end piece, said spiral extension groove of said first end piece has a groove end opening at an axial end face of said first end piece, and said spiral brush strip can be slidingly inserted into and removed from said spiral extension groove of said first end piece and said spiral groove through said groove end opening.

7. The brush roller according to claim 6, wherein said spiral groove is continuous and uninterrupted along an entirety of said axial length of said brush body, and said spiral brush strip is continuous and uninterrupted along an entirety of said total axial length of said brush body plus said two end pieces.

8. The brush roller according to claim 6, wherein said end pieces are each respectively connected by a form-fitting connection into said brush body, which prevents a relative rotation of said end pieces relative to said brush body to keep said spiral extension grooves aligned with said spiral groove.

9. The brush roller according to claim 6, wherein said end pieces are each respectively connected by a form-fitting connection into said brush body, and each said form-fitting connection respectively comprises two elastic material O-rings fitted onto a portion of each respective one of said end pieces that is fittingly inserted into said brush body.

10. The brush roller according to claim 6, wherein said outer circumferential surface of each one of said end pieces extends axially from and is flush with said outer circumferential surface of said brush body.

11. The brush roller according to claim 6, wherein said spiral extension groove of a second one of said end pieces extends at least partially along an axial length of said second end piece.

12. The brush roller according to claim 6, wherein said spiral extension groove of a second one of said end pieces extends entirely along an axial length of said second end piece, said spiral extension groove of said second end piece has a groove end opening at an axial end face of said second end piece, and said spiral brush strip can be slidingly inserted into and removed from said spiral extension groove of said second end piece and said spiral groove through said groove end opening of said second end piece.

13. The brush roller according to claim 6, wherein said spiral brush strip can be inserted into and removed from said spiral groove via said spiral extension groove of said first end piece without removing either one of said end pieces from said brush body.

14. The brush roller according to claim 6, wherein said brush body comprises an outer cylindrical body, an inner cylindrical body arranged coaxially within and radially spaced apart from said outer cylindrical body, and ribs extending radially between and interconnecting said outer and inner cylindrical bodies.

15. The brush roller according to claim 14, wherein said spiral groove is formed in said outer cylindrical body and opens radially inwardly into a space between said inner and outer cylindrical bodies, and said hollow interior space of said brush body is formed coaxially within said inner cylindrical body.

16. The brush roller according to claim 6, wherein said hollow interior space of said brush body extends along said axis coaxially centrally within said brush body and is hollow and unoccupied axially between said two shaft pieces.

17. The brush roller according to claim 6, wherein an axial end face of at least one of said end pieces has plural holes therein, and at least one balancing weight fitted into at least one of said holes.

18. Brush roller according to claim 4, wherein the elements of elastic material comprise O-rings.

* * * * *